US006684548B1

(12) United States Patent
Petrus

(10) Patent No.: US 6,684,548 B1
(45) Date of Patent: Feb. 3, 2004

(54) LOCKING ASSEMBLY FOR SECURING FIREARMS AND THE LIKE

(76) Inventor: Victor M. Petrus, 1497 S. Lakeshore Dr., Ludington, MI (US) 49431-9355

( * ) Notice: Subject to any disclaimer, the term of this patent is extended or adjusted under 35 U.S.C. 154(b) by 0 days.

(21) Appl. No.: 10/354,554

(22) Filed: Jan. 30, 2003

(51) Int. Cl.[7] ..... F41A 17/00

(52) U.S. Cl. ..... 42/70.11; 211/64; 211/4; 70/58; 70/229; 70/232

(58) Field of Search ..... 42/70.11; 70/58, 70/61, 229, 231, 232; 211/4, 7, 64

(56) References Cited

U.S. PATENT DOCUMENTS

| | | | | | |
|---|---|---|---|---|---|
| 4,182,453 | A | * | 1/1980 | Worswick | 211/4 |
| 4,198,026 | A | * | 4/1980 | Capolupo | 248/552 |
| 4,444,031 | A | | 4/1984 | Watson | 70/159 |
| 4,751,831 | A | | 6/1988 | Morris, Jr. et al. | 70/232 |
| 5,022,536 | A | * | 6/1991 | Pierson | 211/64 |
| 5,579,923 | A | * | 12/1996 | Hemmerlein | 211/4 |
| 5,794,463 | A | | 8/1998 | McDaid | 70/18 |
| 6,393,877 | B1 | * | 5/2002 | Church | 70/62 |
| 6,588,242 | B1 | * | 7/2003 | Beaty | 70/231 |

* cited by examiner

*Primary Examiner*—J. Woodrow Eldred
(74) *Attorney, Agent, or Firm*—King & Jovanovic, PLC

(57) ABSTRACT

A locking assembly for securing an object to a wall comprising a sleeve, a fastening assembly and a lock. The sleeve includes a body, an axial bore and an opening through the body. The axial bore includes a internal fastener assembly contact surface. The fastening assembly is capable of extending through the sleeve and into engagement with a wall, and includes a collar and a threaded fastener. The collar includes an axial bore mating surface. The threaded fastener includes a tool engagement region and a wall engagement region. The lock includes a portion which is positionable through the at least one opening in the body. The internal fastener assembly contact surface and the axial bore mating surface interface to facilitate rotative and pivotable relative movement of the sleeve and the fastening assembly. In turn, the retained movement of the fastening assembly with rotation of the sleeve is precluded.

20 Claims, 5 Drawing Sheets

LOCKING ASSEMBLY FOR SECURING FIREARMS AND THE LIKE

BACKGROUND OF THE INVENTION

1. Field of the Invention

The present invention relates in general to locking assemblies, and more particularly to a locking assembly for use in the securement of firearms and the like. It will be understood that firearms are used for exemplary purposes solely, as the locking assembly likewise has utility in association with other items as diverse as power equipment and computers and the like.

2. Background Art

The use of locks and other securement mechanisms to secure firearms has been increasingly popular. Avid gun collectors are desirous of displaying their weapons in a safe, ornate and easily accessible manner. Certain collectors maintain guns in safes. Such safes do not permit the display of the guns. Other collectors place their guns in glass cabinets for display. One drawback is that the guns can be easily removed and are difficult to secure in a glass cabinet, and in turn, they may not be fully childproof. Other gun collectors shackle the guns together with pad-locks and chains. Such securement methods, while somewhat effective, do not provide a pleasant ornamental display. Moreover, such securement methods are relatively expensive.

Other securement mechanisms have been developed which rely on a movable member which is attached to a member that is substantially fixed onto an outside surface. While such securement mechanisms offer certain advantages, it is often easy to jam the movable part and the fixed part together, to, in turn, utilize the movable part to pry or to otherwise force the fixed part from engagement with the outside surface.

Accordingly, it is an object of the invention to provide a locking assembly which facilitates the retention of firearms and the like in an ornamental, yet secure fashion.

It is another object of the invention to improve locking assemblies, including, those used in association with firearms.

These objects as well as other objects of the present invention will become apparent in light of the present specification, claims, and drawings.

SUMMARY OF THE INVENTION

The invention comprises a locking assembly for substantially securing an object to a wall. The locking assembly comprises a sleeve, a fastening assembly and a lock. The sleeve includes a body, an axial bore and at least one opening through the body. The axial bore extends through the body, and includes a internal fastener assembly contact surface. The fastening assembly is capable of extending through the sleeve and into engagement with a wall. The fastening assembly includes a collar and a threaded fastener. The collar includes an axial bore mating surface and a threaded fastener having a tool engagement region and a wall engagement region. The lock includes a portion which is positionable through the at least one opening in the body. The internal fastener assembly contact surface of the sleeve and the axial bore mating surface of the collar interface to facilitate rotative and pivotable movement of the sleeve relative to the fastening assembly, and to, in turn, preclude the retained movement of the fastening assembly with rotation of the sleeve.

In a preferred embodiment, the collar further includes a fastener engagement surface and the fastener further includes a collar engagement region.

In another preferred embodiment, the collar and the fastener comprise an integrated assembly.

Preferably, the collar further comprises a wall engagement surface.

In one embodiment, the sleeve includes a pair of openings positioned proximate the second end of the body.

In a preferred embodiment, the wall engagement region comprises a threaded region.

In another embodiment, the tool engagement region is selected from the group consisting of: a Phillips or flathead screw head, an internal or external multi-sided head, and, a bolt head.

In another embodiment, the lock comprises a padlock.

Preferably, the internal fastener assembly contact surface comprises an internally concave surface. In one such embodiment, the axial bore mating surface of the collar comprises an outwardly convex surface capable of interfacing with the internally concave surface of the internal fastener assembly contact surface.

In another preferred embodiment, the sleeve further includes a coating associated with an outer surface thereof.

BRIEF DESCRIPTION OF THE DRAWINGS

The invention will now be described with reference to the drawings wherein.

DETAILED DESCRIPTION OF THE INVENTION

Figure 1:
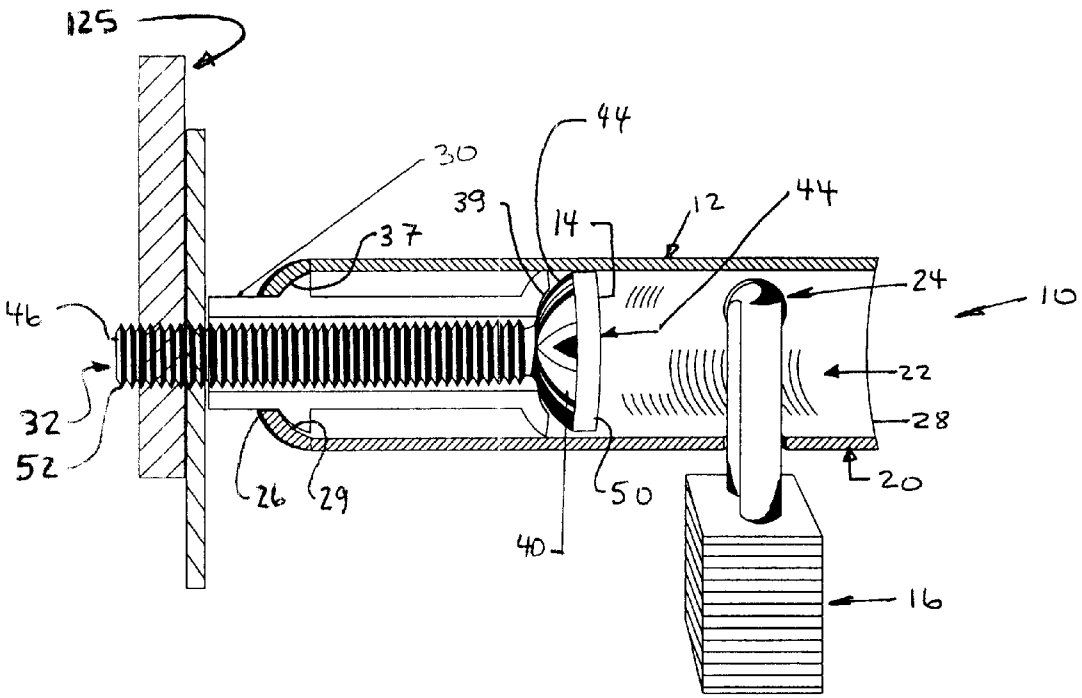
FIG. 1 of the drawings is a partial cross-sectional view of a locking system of the present invention, showing, in particular, a separate collar and fastener, intended for use in association with a relatively hard wall material.

While this invention is susceptible of embodiment in many different forms, there is shown in the drawings and described herein in detail a specific embodiment with the understanding that the present disclosure is to be considered as an exemplification of the principles of the invention and is not intended to limit the invention to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 5:
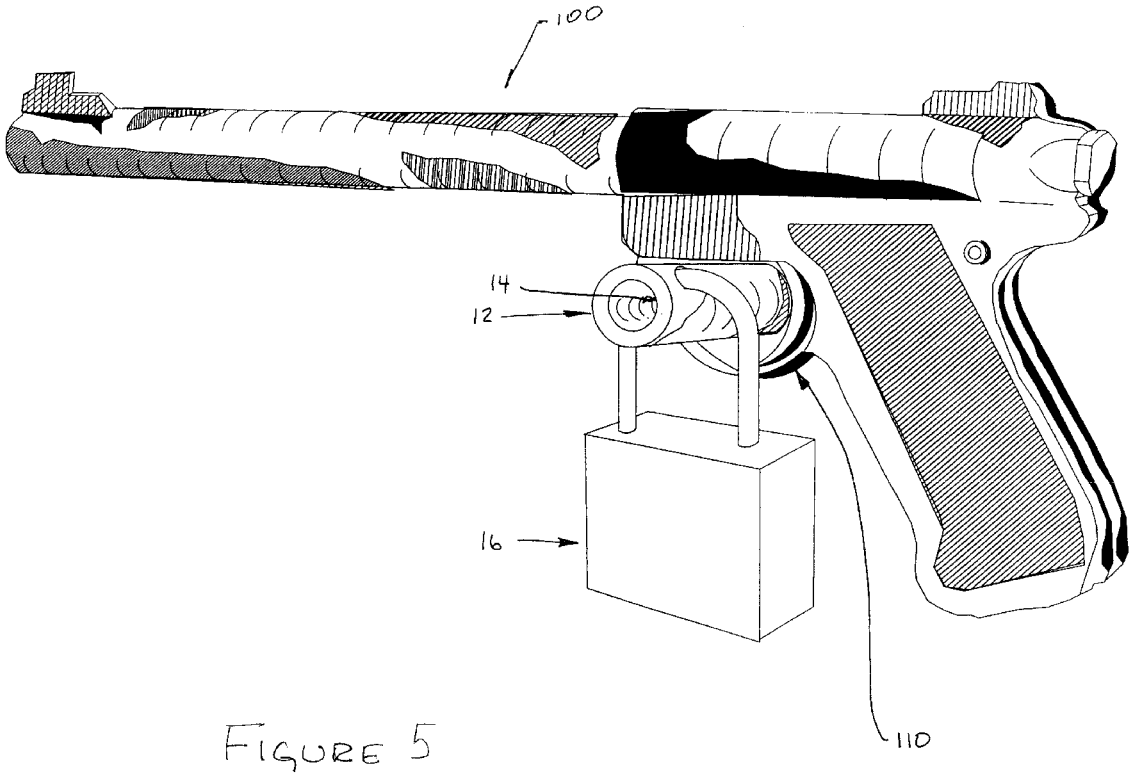
FIG. 5 of the drawings is a perspective view of a locking system of the present invention, showing the use thereof in association with a firearm.

Referring now to the drawings and in particular to FIG. 1, locking assembly 10 comprises sleeve 12, fastening assembly 14 and lock 16. As is shown in FIG. 5, locking assembly 10 is configured for use in association with the securement of a firearm, such as firearm 100 (while securement of other objects is likewise contemplated). As will be explained, locking assembly 10 is attached to a wall and securement to a firearm is achieved by way of cooperation of the locking assembly with trigger guard 110 of firearm 100. In other uses, it is contemplated that the locking assembly may be attached to the device to be protected, and a lock may attach same to an outside surface. It is contemplated that locking assembly 10 comprises a hardened steel set of components, however other lightweight and high strength materials are contemplated for use.

Sleeve 12 is shown in FIG. 1 as comprising body 20, axial bore 22, and openings 24. Body 20 includes first end 26 and second end 28 distally spaced apart from first end 26. Body 20 generally includes an elongated substantially circular cross-sectional configuration. It is contemplated that the length of the body is generally such that it can easily accommodate the receipt of a firearm and a lock, but it is not long enough to provide a sufficient moment arm for one who is trying to disengage the assembly from a wall. Of course, other configurations are likewise contemplated for use, including square, elliptical and other cross-sectional configurations. In addition, certain non-uniform cross-sectional configurations are likewise contemplated for use (i.e., a cross-sectional configuration which mimics the contours of the trigger lock of a firearm).

It is contemplated that in certain embodiments, a cover such as a neoprene material or another insulative material may be positioned or applied over the body 20 of sleeve 12 to preclude marring or scraping of the trigger guard or other component of the firearm. Additionally, it is contemplated that such a material may likewise foster the retention of the firearm in a desired orientation and limit the sliding or rotation of the firearm about the sleeve when the locking assembly is in use.

Axial bore 22 extends from first end 26 to second end 28. The bore is substantially uniformly configured, such that the body comprises a generally uniform thickness across the length thereof. Axial bore 22 proximate first end 26 further includes internal fastener assembly contact surface 29. In the embodiment shown, the internal fastener assembly contact surface comprises an inwardly concave internal surface. Such a beveled surface generally results in an narrowing or altering of the size of the opening of the axial bore proximate first end 26. As will be explained, such an internal surface cooperates with the fastening assembly to preclude the defeat of the locking assembly.

Openings, such as opening 24 extend through body 20 proximate the second end thereof. In certain embodiments, a single opening may be utilized, whereas, in other embodiments, multiple openings may be positioned proximate each other about the second end of the body. As will be explained, a lock or other selectively removable securement mechanism may be positioned through the openings to preclude access to the axial bore and to preclude the slidable movement of objects along the axial bore.

Fastening assembly 14 is shown in FIG. 1 as comprising collar 30 and threaded fastener 32. Collar 30 includes axial bore mating surface 37 and fastener engagement surface 39. Axial bore mating surface 37 extends about the outer end of collar 30 and contacts the axial bore. The axial bore mating surface is configured so as to permit both rotative movement of the collar relative to the sleeve, and to likewise permit pivoting and or "wobbling" of the collar relative to the sleeve (i.e., the contact between the elements is spread over a relatively large contact surface area). The configuration is such that the collar and the sleeve are generally precluded from lockable or restrainable movement in unison.

Fastener engagement surface 39 is shown in FIG. 1 as comprising an engagement surface which facilitates the pivoting, rotating and "wobbling" of a fastener relative to the collar. In the embodiment shown, the fastener engagement surface may comprise a compound curved beveled surface. Of course, other configurations are likewise contemplated, depending on the particulars of the application.

Variations in the configuration of the collar are contemplated. For example, in the embodiment shown in FIGS. 1 and 3, the assembly is contemplated for use in association with a relatively hard surface (i.e., a metal surface). In such an instance, collar 30 extends beyond first end 26 of the body 20 and beyond the axial bore thereof. As will be explained, during the construction, it is the collar that is directly attached to the underlying surface, and the sleeve is free to rotate, pivot and "wobble."

Figure 2:
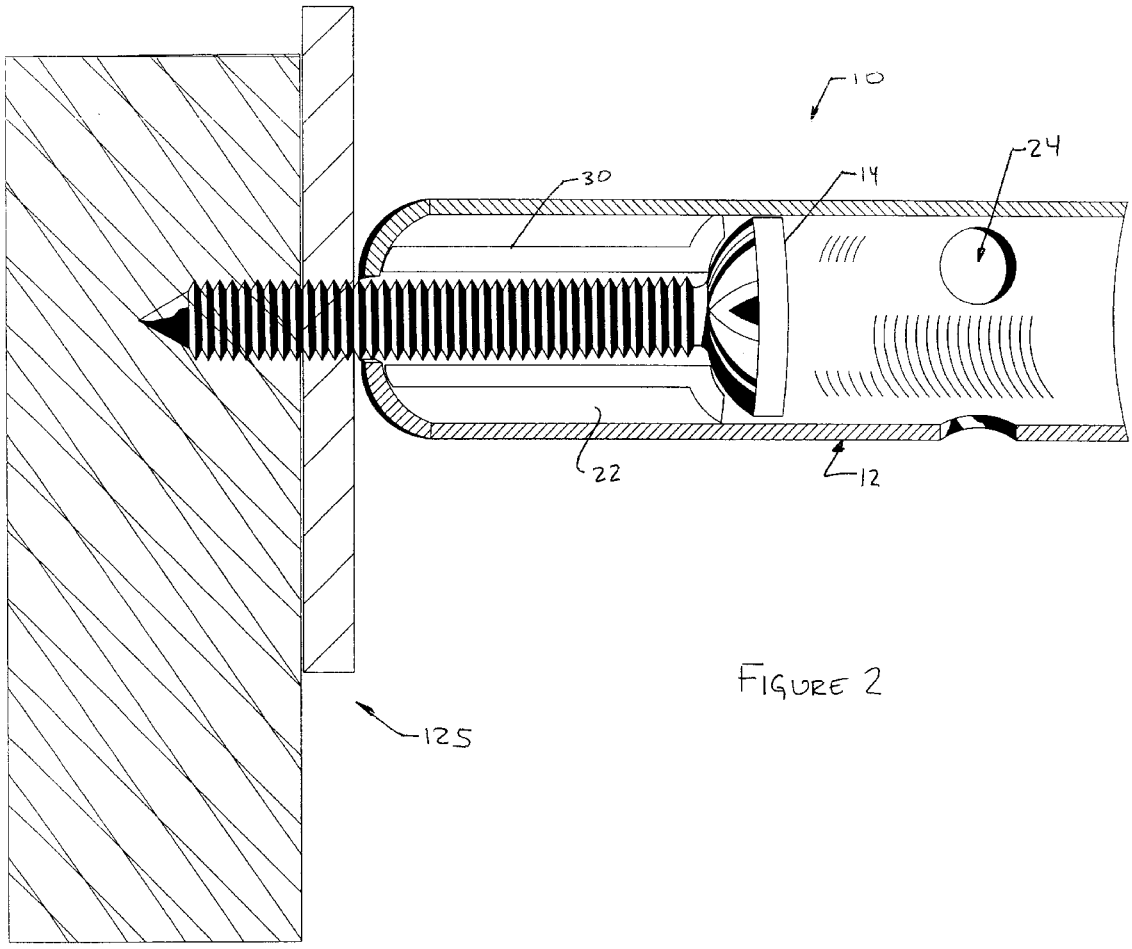
FIG. 2 of the drawings is a partial cross-sectional view of a locking system of the present invention, showing, in particular, a separate collar and fastener, intended for use in association with a relatively soft wall material.
Figure 4:
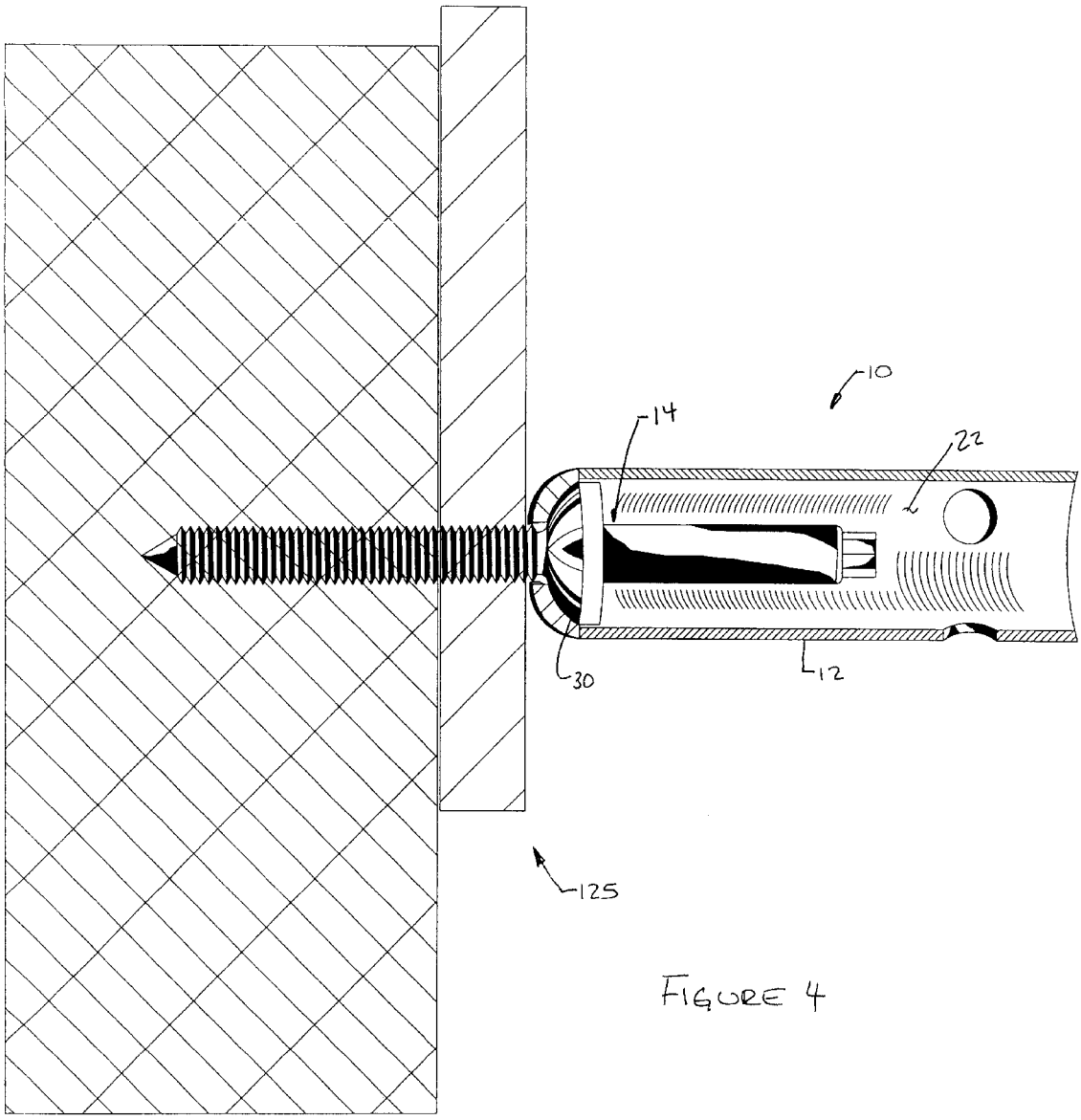
FIG. 4 of the drawings is a partial cross-sectional view of a locking system of the present invention, showing, in particular, an integrated collar and fastener, intended for use in association with a relatively soft wall material.

Additionally, in the embodiment of FIGS. 2 and 4, the assembly is contemplated for use in association with a relatively soft surface, such as wood, fiberboard, drywall, etc. In such an embodiment, the collar is contained within the axial bore of sleeve 12. As such, the first end of body 20 contacts the underlying surface, however, due to the relative softness of the material, the body is free to rotate about collar enclosed within the axial bore.

Threaded fastener 32 is shown in FIG. 1 as comprising body 40, tool engagement region 42, collar engagement region 44 and wall engagement region 46. Body 40 generally comprises an elongated body having a first end 50 and second end 52. Tool engagement region 42 is positioned proximate first end 50 of body 40. The tool engagement region may comprise any number of structures to which tools may be interfaced to, in turn, rotate the body. For example, the tool engagement region may comprise a Phillips or flathead screw head, an internal or external multi-sided head, a bolt head, among others. Additionally, safety or tamper resistant fasteners are likewise contemplated for use. Indeed, the invention is not limited to any particular type of tool engagement region.

Collar engagement region 44 is shown in FIG. 1 as comprising a surface which is capable of mating with the fastener engagement surface 39 of collar 30. In one embodiment, collar engagement region 44 comprises a compound curved beveled surface which substantially corresponds to the fastener engagement surface 39. Such a configuration facilitates the rotation, pivoting and "wobbling" of the fastener and the collar relative to each other. Of course, in other embodiments, other surface configurations for the collar engagement region are contemplated, as long as the above-described interaction with the collar can be achieved.

Wall engagement region 46 may comprise any number of different configurations, depending on the particular material from which wall 125 is constructed. For example, the wall engagement region may be threaded so as to facilitate attachment to a drywall/stud or to a wood material. In other embodiments, the wall engagement region may comprise threaded for securement to a sheet metal structure, a concrete or other masonry structure, or to a plastic structure. In still other embodiments, the wall engagement region can be configured with machine threads for releasable attachment to an outside surface with a nut (i.e., a nut and bolt arrangement). Of course, other attachment structures for attachment to a wall are contemplated for use.

Figure 3:
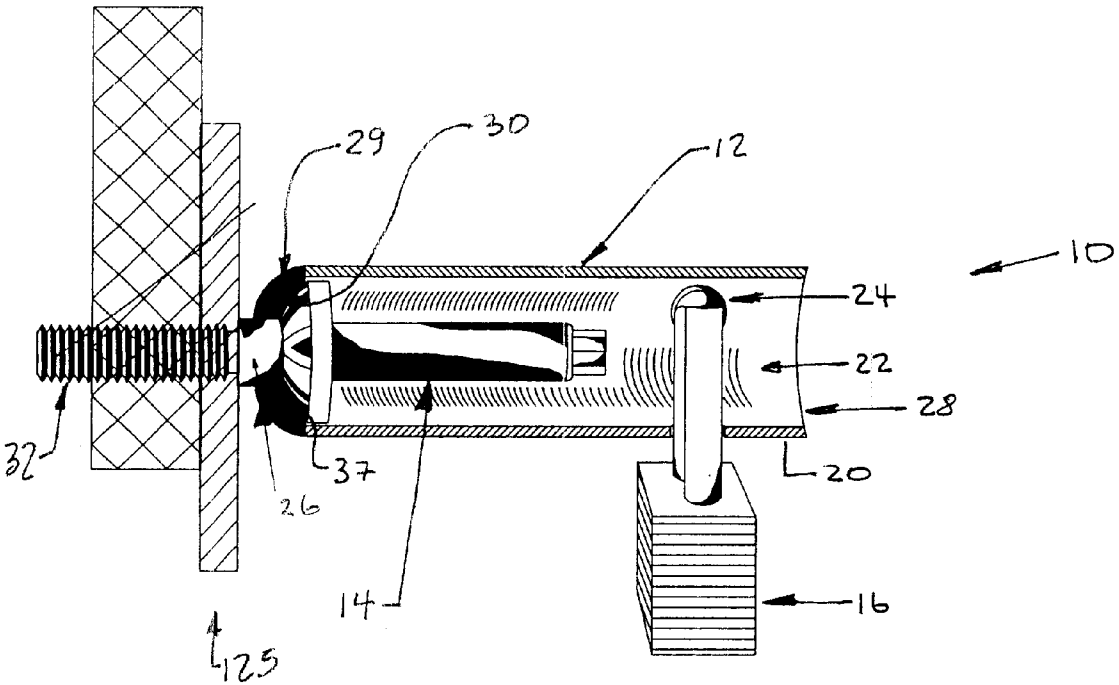
FIG. 3 of the drawings is a partial cross-sectional view of a locking system of the present invention, showing, in particular, an integrated collar and fastener, intended for use in association with a relatively hard wall material.

It is contemplated that in certain embodiments, such as the embodiment shown in FIGS. 3 and 4, collar 30 and fastener 32 may be integrated into a single member. In such an embodiment, a fastener engagement region and a collar engagement region is not utilized, as the components are integrated. It will be understood that depending on the wall material and the configuration selected, collar 30 may extend beyond axial bore 22 (FIG. 3), or may be retained within the axial bore (FIG. 4).

Lock 16 is shown in FIG. 1 as comprising a conventional pad lock. Such pad locks are available from numerous manufacturers, including but not limited to Master Locks and American Locks. Such locks may be opened through combination means or through a separate key. Of course, other locking mechanisms, such as cables, and other locks are likewise contemplated for use.

In operation, the user first selects a region of wall 125 to which the locking assembly is to be attached. Next, the user selects a particular firearm, or set of firearms with which the locking assembly will be associated. Once these have been selected, a sleeve and fastening assembly can be selected. The sleeve is selected such that the sleeve can fit substantially within trigger guard 110 in a substantially snug manner. If the sleeve is too large, then the firearm can not be moved in a slidable fashion along sleeve 12 positioned within the confines of trigger lock 110. On the other hand, if the sleeve is too small, it may be difficult to restrain the firearm, and to preclude the firearm from easily rotating about the sleeve.

With respect to the selection of the fastenening assembly, the user first determines the material from which wall 125 is constructed. For example, different wall engagement regions are utilized with each of wood, drywall/metal studs, concrete. Additionally, threaded fastener and collar (or integrated combination) must be sized so that it can be contained within the axial bore and not protrude beyond openings 24.

Once the desired fastening assembly and sleeve is chosen, the user prepares the wall for receipt of the wall engagement region of the threaded fastener. For example, drilling the wall with a pilot hole may be necessary with certain configurations. Of course, with certain configurations, no such preparation is required. Once the wall is prepared, the fastening assembly and the sleeve are assembled. In particular, collar 30 and threaded fastener 32 are inserted through axial bore 22 from the opening proximate the second end thereof.

Once inserted, a suitable tool can be used to interface with tool engagement region 42 of fastening assembly 14 to, in turn, direct wall engagement region 46 into wall 125. Generally, the wall engagement region is directed into the wall until one of the collar and the first end of body 20 firmly engage wall 125. As explained above, regardless of whether the collar and the fastener comprise integrated or separate components, depending on the embodiment collar 30 may protrude beyond first end 26 of body 20, or collar 30 may be fully contained within the body.

Once the sleeve and fastening assembly are secured to wall 125, firearm 100 may be associated with the sleeve by directing the sleeve through the trigger guard of the firearm. After the firearm is properly associated with the sleeve, lock 16 may be introduced. Specifically, the lock can be extended through openings 24 of sleeve 12 and then secured. The lock thus, spans at least partially across bore 22, thereby precluding access to tool engagement region 42. Additionally, the lock creates an obstacle which precludes slidable detachment of the gun from engagement with the sleeve.

Inevitably, one that is desirous of disabling the locking assembly will attempt to lock the sleeve and the fastening assembly, or wedge the two structures together. The underlying thought is that if the sleeve can be rotated, it will, in turn, rotate the fastening assembly. Further rotation of the fastening assembly would then disengage the fastening assembly from the wall. However, with the construction of axial bore mating surface 37 of collar 30 and bevel surface 29 of axial bore 22, engagement of the fastening assembly by manipulation of the sleeve is precluded by the rotatable and pivotable interaction of these surfaces. In turn, it is not possible to disengage the fastening assembly from the wall by interference thereof with the sleeve.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A locking assembly for substantially securing an object to a wall, the locking assembly comprising:

a sleeve including:

a body;

an axial bore extending through the body, the axial bore having a internal fastener assembly contact surface; and at least one opening through the body;

a fastening assembly capable of extending through the sleeve and into engagement with a wall, the fastening assembly including:

a collar having an axial bore mating surface;

a threaded fastener having a tool engagement region and a wall engagement region; and a lock having a portion which is positionable through the at least one opening in the body, wherein the internal fastener assembly contact surface of the sleeve and the axial bore mating surface of the collar interface to facilitate rotative and pivotable movement of the sleeve relative to the fastening assembly, and to, in turn, preclude the retained movement of the fastening assembly with rotation of the sleeve.

2. The locking assembly of claim 1 further wherein:

the collar further includes a fastener engagement surface; and the fastener further includes a collar engagement region.

3. The locking assembly of claim 1 wherein the collar and the fastener comprise an integrated assembly.

4. The locking assembly of claim 1 wherein the collar further comprises a wall engagement surface.

5. The locking assembly of claim 1 wherein the sleeve includes a pair of openings positioned proximate the second end of the body.

6. The locking assembly of claim 1 wherein the wall engagement region comprises a threaded region.

7. The locking assembly of claim 1 wherein the tool engagement region is selected from the group consisting of: a Phillips or flathead screw head, an internal or external multi-sided head, and, a bolt head.

8. The locking assembly of claim 1 wherein the lock comprises a padlock.

9. The locking assembly of claim 1 wherein the internal fastener assembly contact surface comprises an internally concave surface.

10. The locking assembly of claim 9 wherein the axial bore mating surface of the collar comprises an outwardly convex surface capable of interfacing with the internally concave surface of the internal fastener assembly contact surface.

11. The locking assembly of claim 1 wherein the sleeve further includes a coating associated with an outer surface thereof.

12. A locking assembly for substantially securing an object to a wall, the locking assembly comprising:

a sleeve including:

a body;

an axial bore extending through the body, the axial bore having a internal fastener assembly contact surface; and at least one opening through the body, the at least one opening configured for receipt of a portion of a lock; and a fastening assembly capable of extending through the sleeve and into engagement with a wall, the fastening assembly including:

a collar having an axial bore mating surface;

a threaded fastener having a tool engagement region and a wall engagement region;

wherein the internal fastener assembly contact surface of the sleeve and the axial bore mating surface of the collar interface to facilitate rotative and pivotable movement of the sleeve relative to the fastening assembly, and to, in turn, preclude the retained movement of the fastening assembly with rotation of the sleeve.

13. The locking assembly of claim 12 further wherein:

the collar further includes a fastener engagement surface; and the fastener further includes a collar engagement region.

14. The locking assembly of claim 12 wherein the collar and the fastener comprise an integrated assembly.

15. The locking assembly of claim 12 wherein the collar further comprises a wall engagement surface.

16. The locking assembly of claim 12 wherein the sleeve include a pair of openings positioned proximate the second end of the body.

17. The locking assembly of claim 12 wherein the wall engagement region comprises a threaded region.

18. The locking assembly of claim 12 wherein the internal fastener assembly contact surface comprises an internally concave surface.

19. The locking assembly of claim 18 wherein the axial bore mating surface of the collar comprises an outwardly convex surface capable of interfacing with the internally concave surface of the internal fastener assembly contact surface.

20. A combination firearm and locking assembly for substantially securing the firearm to a wall comprising:

a firearm having a trigger guard;

a sleeve extending through the trigger guard, the sleeve including:

a body;

an axial bore extending through the body, the axial bore having a internal fastener assembly contact surface; and at least one opening through the body;

a fastening assembly extending through the sleeve and into engagement with a wall, the fastening assembly including:

a collar having an axial bore mating surface;

a threaded fastener having a tool engagement region and a wall engagement region; and a lock having a portion which is positioned through the at least one opening in the body, wherein the internal fastener assembly contact surface of the sleeve and the axial bore mating surface of the collar interface to facilitate rotative and pivotable movement of the sleeve relative to the fastening assembly, and to, in turn, preclude the retained movement of the fastening assembly with rotation of the sleeve.

* * * * *